US005112159A

United States Patent [19]

Verret

[11] Patent Number: 5,112,159

[45] Date of Patent: May 12, 1992

[54] STAIRWAY GUARD FOR OFFSHORE MARINE STRUCTURE

[75] Inventor: Allen J. Verret, Abita Springs, La.

[73] Assignee: Texaco, Inc., White Plains, N.Y.

[21] Appl. No.: 620,793

[22] Filed: Dec. 3, 1990

[51] Int. Cl.[5] ..... E02B 17/00

[52] U.S. Cl. ..... 405/195.1; 405/218; 182/97

[58] Field of Search ..... 405/195, 196, 197, 198, 405/202, 203, 218-221; 114/362; 280/166; 182/86, 88, 97

[56] References Cited

U.S. PATENT DOCUMENTS

| | | | |
|---|---|---|---|
| 784,832 | 3/1905 | Bracegirdle | 114/362 X |
| 3,841,439 | 10/1974 | Nilsson et al. | 182/86 |
| 4,115,887 | 9/1978 | Ewards | 114/362 |

FOREIGN PATENT DOCUMENTS

| | | | |
|---|---|---|---|
| 1393323 | 2/1965 | France | 182/86 |
| 2037355 | 7/1980 | United Kingdom | 114/362 |
| 2188667 | 10/1987 | United Kingdom | 114/362 |

*Primary Examiner*—Randolph A. Reese
*Assistant Examiner*—John A. Ricci
*Attorney, Agent, or Firm*—Robert A. Kulason; James J. O'Loughlin; Robert B. Burns

[57] ABSTRACT

A Marine Structure for use in a body of water, having a deck positioned above the water's surface, and a vessel landing stage position at the water surface. A stairway having its upper and hinged to the deck, is normally supported with its lower end in contact with the landing stage. An elevating mechanism depending from the deck is operable to lift the stairway's lower end to a position above the water's surface, adjacent to the deck. The stairway is retained in its raised position by a docking facility, and is secured thereby from damage which could otherwise occur due to strong wind and wave action. An alignment coupling carried on the respective stairway and docking facility allows the two members to be firmly, yet resiliently joined to better resist wind or wave forces.

1 Claim, 2 Drawing Sheets

STAIRWAY GUARD FOR OFFSHORE MARINE STRUCTURE

BACKGROUND OF THE INVENTION

In most marine platforms, particularly those used in offshore work, the structure is subjected to weather conditions which prevail in the area. These structures are constructed to rest on the ocean floor, and are of sufficient durability to maintain a work platform or deck a desired distance above the water's surface.

Since structures of this type are fully exposed to the weather, they must be built and protected to resist damage that might occur as a result of inclement weather such as storms or even hurricane conditions. In the instance of the latter, the combined action of wind and waves can be devastating unless exposed parts of the structure are either protected or sufficiently reinforced to resist the condition.

Although the marine structures here contemplated are fabricated of steel columns and members, the more fragile segments of the platform can sustain damage due to severe contact by wind and high waves.

In the instance of the platform's stairway which extends from the deck downward to the water's surface, the stair structure, by its nature is relatively fragile and susceptible to damage. Even in those instances where the stairway can be elevated to be beyond the reach of damaging waves, the structure is none the less exposed to high winds which can cause twisting and distortion.

Toward overcoming this susceptible feature in a marine structure, as hereinafter disclosed, the structure's access stairway which extends between the platform's deck and its landing stage, is fabricated such that the stairway is laterally braced against forceful lateral displacement. Such displacement could result from contact between the stairway and driven water or high winds.

The stairway is articulated to the extent of being pivotally engaged at its upper end to the marine structure. The stairway lower end, however, can be elevated to a position such that the entire unit will be in a raised condition.

Reinforcement of the raised lower end is assured by registering said lower end in a docking structure which depends from the platform's deck section.

It is, therefore, an object of the invention to provide an offshore structure's access stairway which is capable of withstanding severe and adverse weather conditions at an offshore site.

A further object is to provide a marine structure in which the access stairway between the elevated working deck and the water level, can be adjusted to a raised, braced position which puts it beyond reach of waves and the like.

DESCRIPTION OF THE DRAWINGS

Referring to FIG. 1, a marine structure 10 of the type contemplated is pictured at an offshore body of water such as at a well drilling or producing site. At such a site, particularly in the drilling and producing of crude oil and gas from the ocean floor 11, the structure includes a working deck 12 which is, for practical purposes, positioned approximately 50 feet above the water's surface 13.

Figure 1:
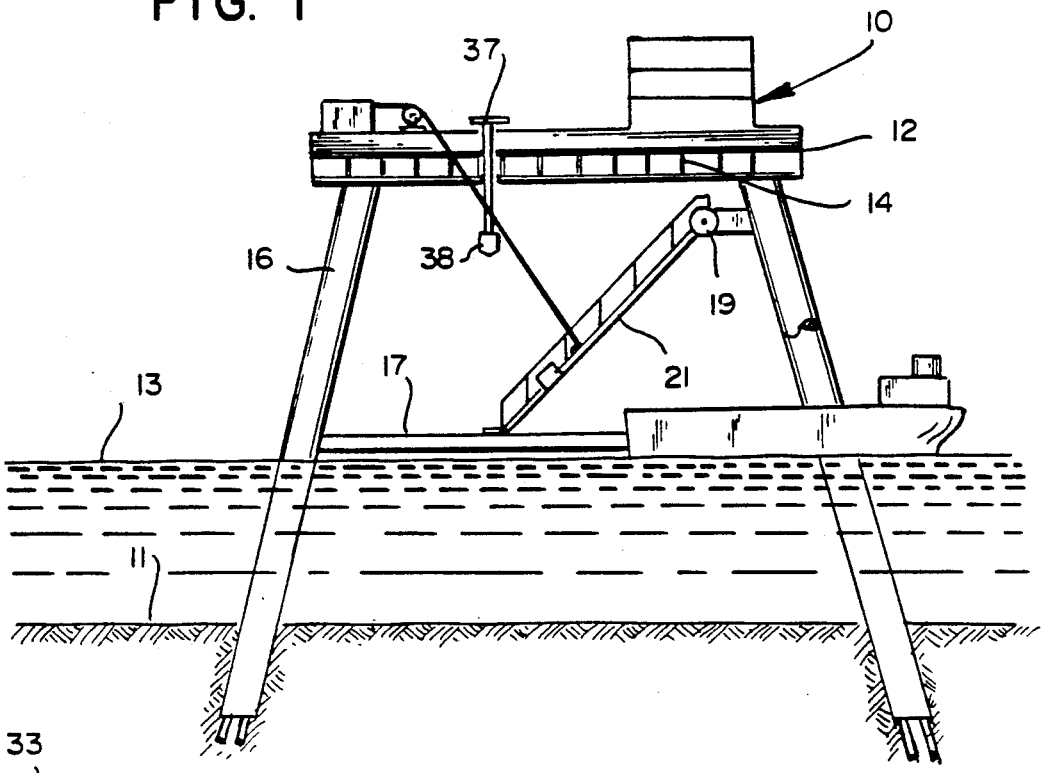
FIG. 1 is an environmental representation of an offshore structure of the type contemplated embodying the disclosed stairway feature.

Deck 12 can constitute an elevated structure which supports crew personnel as well as the equipment used in a drilling operation. The structure can also include one or more derricks of the type found at such structures wherein wells are drilled into ocean floor 11.

Deck 12, as noted, is positioned to an elevation above the water's surface 13 depending on the weather conditions which prevail at the particular drill site. Deck 12 in one form is comprised of transverse support members 14 to which the various housings and operational equipment are fixed.

Deck 12 is supported in its elevated position by one or more, and preferably, by a plurality of columns or legs 16. The latter are connected at their upper ends to deck 12 and are driven into ocean floor 11 a sufficient distance to secure the structure against the damage and displacement under adverse weather conditions. The depth to which support columns 16 are driven into the sea floor is a function of the subsoil characteristics into which the legs are embedded, and on the weather conditions at the site.

Structure 10 is further provided with a landing stage 17 which is fastened to support columns 16 and positioned adjacent to the water's surface 13. Landing stage 17, as it will be hereinafter referred to, is normally located such that it is accessible to work vessels which carry personnel, equipment and supplies between the structure and the shore.

As a practical measure, landing stage 17 is positioned adjacent to the water's surface with a recognition of tidal action which can vary within a range of heights, again depending on the site's location.

Landing stage 17 is provided with means to accommodate vessels which dock there for loading and unloading cargo.

To facilitate access by personnel between landing stage 17 and the deck 13, a stairway 21 is provided.

Figure 2:
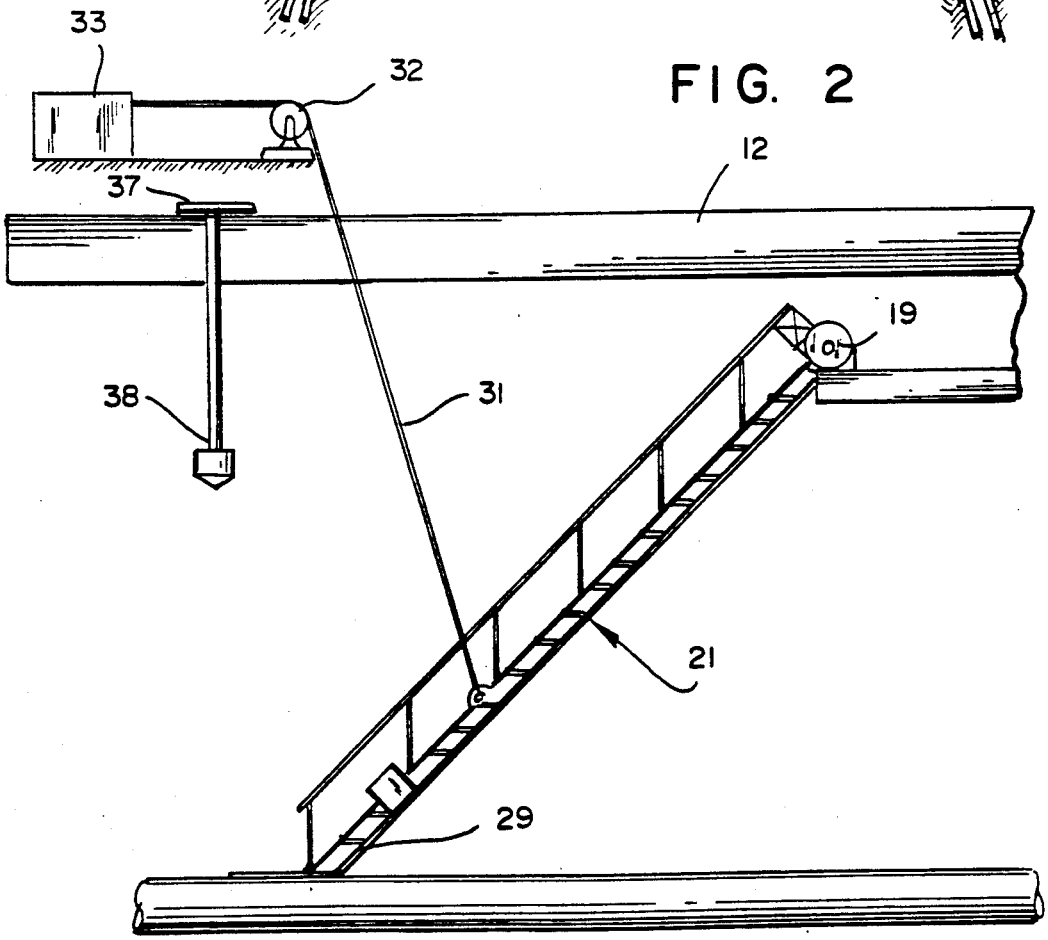
FIG. 2 is an enlarged segmentary view of the marine structure's stairway shown in its elevated position.
Figure 3:
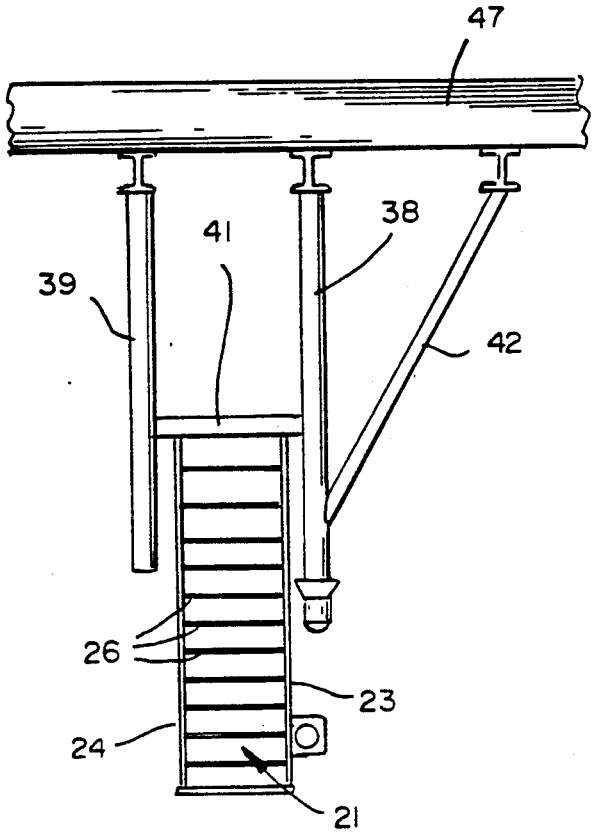
FIG. 3 is a partial end view of FIG. 1.

Referring to FIGS. 2 and 3, stairway 21 is connected to deck 12 in a manner that even though it may be sectioned, it is operably engaged at its upper end to deck 12. The stairway includes basically a pair of steel, spaced apart stringer members 23 and 24 to which the step sections 26 are fixed. The stairway 21 upper end as shown in one embodiment includes hinged connection 19. The stairway lower end 29 can be provided with a roller, or it can rest on the stage 17 floor to be end supported. Operationally, the hinged upper connection 19, permits the stairway to be pivotally raised to a displaced or substantially horizontally positioned where it will be beyond the reach of storm waves.

The stairway raising and lowering mechanism includes an elongated cable 31 which is connected at one end to the stair structure at a connector 34, and at the other end to a cable windup system 32. Said windup as illustrated, includes drum 32 which, in the usual manner, is wound with cable 31. A motor 33 or other power source coupled to drum 32 controls rotation of the latter and functions as a latching mechanism to retain the stairway with its lower end in the elevated position.

Referring to FIG. 2, although the lower end 29 of stairway 21 is normally supported on landing stage 17, in the displaced position it can be elevated to a substantially horizontal disposition. This is achieved by actuating motor 33 to wind the cable in.

In the past, stairways on marine platforms have been utilized, and could also be raised beyond reach of wind and water to avoid damage and/or even destruction. In the present arrangement, rather than merely raising stairway 21 out of harms way, it is elevated to engage a stair bracing and docking system.

In the shown embodiment, the stairway docking means includes a support bar 37 which depends outward from deck 12. A plurality of, and preferably two substantially vertically arranged guide columns 38 and 39 are fixed to, and extend downwardly from support bar 37 to terminate approximately at the level of deck 12. Each of said guide columns can be provided with an engaging means at the lower end thereof to define a cushioned connection against which the stairway will be braced.

Figure 4:
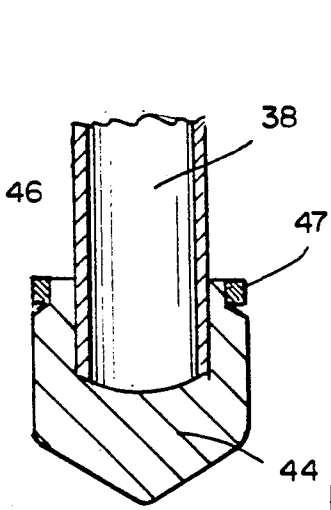
FIG. 4 is a segmentary view of FIG. 3.
Figure 4:
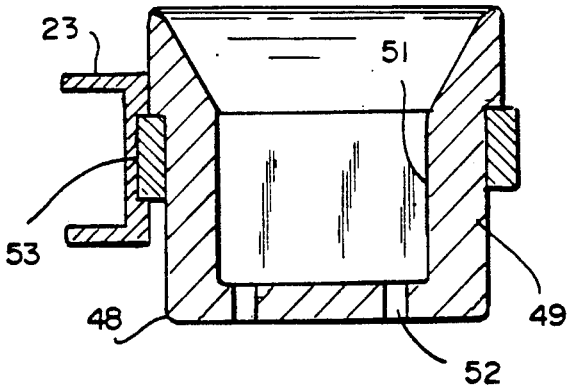

As shown in FIGS. 3 and 4, the lower end of at least one docking column 38 is provided with a receptor which can be formed of a flexible material capable of absorbing the shock of waves forcefully striking stairway 21. Thus, the cushioning system as shown includes a cushioning collar 44 which depends from the lower end of column 38.

Guide columns 38 and 39 are spaced apart to define a stairway registering docking slip, and are further provided with means to resist lateral displacement by a cross brace 41. The latter engages each of the columns at an end welded connection. Further lateral bracing is provided through an outboard arm 42 which depends from support bar 37.

Figure 5:
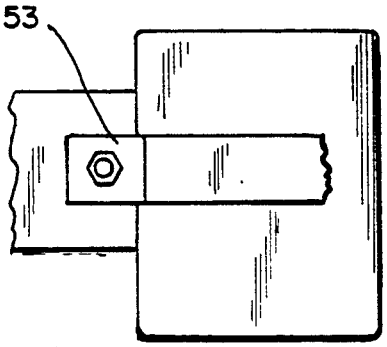
FIG. 5 is a side view of FIG. 4.

Referring to FIGS. 4 and 5, the docking apparatus as mentioned, includes means to properly align, as well as to cushion the mobile stairway, with the fixed or stationary docking members 38 and 39 during a stairway elevating operation. In the shown embodiment, at least one of the columns 38 is provided with a cushioning connector which includes an upper segment fixed to the post 38 lower end. Said segment or collar 44 in one embodiment, includes a rounded or conically shaped forward end formed of a compressible, yet resilient material such as rubber or the like.

A rearwardly extending body section 46 includes an internal cavity which registers about the column 38 lower periphery. Said collar can be fastened to the column end by any one of several convenient means, such as by a peripheral band 47. The latter is tightened about column 38 periphery, band 47 being maintained in place by a bolt or similar means.

The cooperative alignment segment 48 carried on stairway 21 includes in one embodiment, a generally cylindrical shaped member having an internal cavity 51. Said cavity includes a lower cylindrical section having a diameter adequate to slidably register collar 44 therein. An inwardly convergent guide section 52 extends downwardly into the cylindrical casing, terminating in an opening 52 which serves as a drain to pass rain water therefrom.

The lower alignment segment 48 is fastened to a longitudinal stringer 23 of the stairway 21 by an encircling bracket 53 which is bolted to the stringer section at spaced apart holes.

Operationally, as stairway 21 is raised from its normal position in supported contact with landing stage 17, the stairway will approach the docking and support columns 38 and 39. To assure proper registration of the stairway between the two columns, the coupling segments 44 and 49 are arranged such that the upper, conically formed section will register within the outwardly flared guide section 51 of the lower segment. The stairway can thus be held in position by a suitable latchable arrangement such as by the above noted elevating cable mechanism.

Thereafter, the alignment coupling will cause the stairway to assume a safe position between the bracing posts 38 and 39. At this point the stairway can be secured or merely remain as it is in view of the resilient contact between the two alignment segments at the resilient or flexible joint formed by their respective mating segments.

It is understood that although modifications and variations of the invention can be made without departing from the spirit and scope thereof, only such limitations should be imposed as are indicated in the appended claims.

What is claimed is:

1. In a Marine structure for use in a body of water, which structure includes:

a deck positioned above the water's surface, a vessel landing stage depending from said structure, a stairway having an upper end operably engaged to said deck at a hinged joint to allow pivotal movement of the stairway about said joint when the stairway is raised into its upper position, and having a lower end supported on said landing stage, elevating means depending from said deck and engaging said stairway, being operable to raise the stairway lower end from a lowered position in contact with the landing stage, to an upper position when the stairway lower end elevated above said landing stage, .

docking means depending from said deck to slidably register said stairway when the latter is adjusted to said upper position, said docking means including a plurality of docking guide members depending downwardly from said deck, defining a downwardly extending stairway registering docking slip therebetween, latching means being operable to fixedly engage the stairway to docking guide members when the stairway is in the upper position, each of said plurality of docking guide members including a flexible coupling at the lower end thereof, positioned to engage a mating coupling member on the stairway, to define a cushioned connection, at least one of said plurality of docking members including a collar fixed to said at least one guide member, and said stairway including a generally cylindrical shaped member defining a cavity therein of sufficient size to slidably register said collar when the stairway is raised to said elevated position.

* * * * *